US005241304A

United States Patent [19]

Munetsugu et al.

[11] Patent Number: 5,241,304

[45] Date of Patent: Aug. 31, 1993

[54] DOT-MATRIX DISPLAY APPARATUS

[75] Inventors: Eiichi Munetsugu; Kiyoshi Hidaka, both of Yokohama, Japan

[73] Assignee: Kabushiki Kaisha Toshiba, Kawasaki, Japan

[21] Appl. No.: 535,145

[22] Filed: Jun. 8, 1990

[30] Foreign Application Priority Data

Jun. 12, 1989 [JP] Japan ..... 1-148991

[51] Int. Cl.[5] ..... G09G 3/36

[52] U.S. Cl. ..... 340/784; 340/718

[58] Field of Search ..... 340/784, 805, 789, 718, 340/719, 799; 350/332, 333; 359/54, 55

[56] References Cited

U.S. PATENT DOCUMENTS

| | | | |
|---|---|---|---|
| 4,804,251 | 2/1989 | Jacobs | 340/784 |
| 4,837,566 | 6/1989 | Channing et al. | 340/781 |
| 4,908,710 | 3/1990 | Wakai et al. | 340/799 |
| 4,917,468 | 4/1990 | Matsuhashi et al. | 340/805 |

FOREIGN PATENT DOCUMENTS

| | | |
|---|---|---|
| 0241562A1 | 10/1987 | European Pat. Off. . |
| 0274942A3 | 7/1988 | European Pat. Off. . |
| 0287055A3 | 10/1988 | European Pat. Off. . |
| 2106690 | 4/1983 | United Kingdom . |
| 2138615A | 10/1984 | United Kingdom . |

OTHER PUBLICATIONS

Kaneko, "Directly Addressed Matrix Liquid Crystal Display Panel With High Information Content," 2322 Molecular Crystals & Liquid Crystals 139 Nos. 1-2, pp. 81-101, Montreux, Switzerland, published 1986.

*Primary Examiner*—Alvin E. Oberley
*Assistant Examiner*—Regina Liang
*Attorney, Agent, or Firm*—Finnegan, Henderson, Farabow, Garrett & Dunner

[57] ABSTRACT

A dot-matrix display apparatus comprising a display panel and two integrated circuits. The panel has a number of column electrodes extending vertically and parallel to one another, and a number of row electrodes extending horizontally and parallel to one another. Two TAB films are secured to the upper and lower edges of the panel. The integrated circuits are mounted on these TAB films, respectively. The first integrated circuit distributes odd-numbered ones of pixel data items simultaneously to the odd-numbered column electrodes, whereas the second integrated circuit distributes the even-numbered pixel data simultaneously to the even-numbered column electrodes. Either integrated circuit has an interface circuit and a control circuit, which cooperate to select the odd-numbered pixel data items or the even-numbered pixel data items. The pixel data items, thus selected, are stored into a RAM, and are supplied to the column electrodes, when necessary.

9 Claims, 7 Drawing Sheets

DOT-MATRIX DISPLAY APPARATUS

BACKGROUND OF THE INVENTION

1. Field of the Invention

The present invention relates to a dot-matrix liquid crystal display apparatus, and more particularly, to a drive circuit for driving a liquid-crystal display panel, thereby to display characters and images in the form of dot-matrix patterns.

2. Description of the Related Art

Conventional liquid-crystal display panels, for displaying characters in the form of dot-matrix patterns having a sealed panel, comprise a front glass plate and a back glass plate which oppose each other across a narrow space filled with liquid crystal. A number of strip-shaped column electrodes are arranged parallel to one another on the inner surface of the front glass plate, and a number of strip-shaped row electrodes are arranged parallel to one another and at right angles to the column electrodes, on the inner surface of the back glass plate, in rows and columns, on the inner surface of the front glass plate. Those portions of the liquid crystal, which are located at the intersections of the column electrodes and the row electrodes function as pixels. Hence, the pixels are arranged in a matrix pattern, that is, in rows and columns.

FIG. 8 shows a conventional dot-matrix liquid crystal display apparatus having a typical structure. The display apparatus has a liquid-crystal display panel 60 filled with liquid crystal and having a number of column electrodes 61*l* to 61*n* extending in the vertical direction, and a number of row electrodes 62*l* to 62*m* extending in the horizontal direction and, hence, at the right angle to the column electrodes 61*l* to 61*n*. Those portions of the liquid crystal which are located at the intersections of the column electrodes 61*l* to 61*n* and the row electrodes 62*l* to 62*m* function as pixels. Needless to say, the pixels are arranged in a matrix pattern, that is, in rows and columns.

A pair of tape-automated bonding (TAB) films 631 and 632 are secured to the upper edge of the display panel 60. Semiconductor LSI chips 641 and 642, both designed for use in liquid crystal display devices, are mounted on these TAB films 631 and 632, respectively. Either LSI chip has output terminals which are connected to the column electrodes 61*l* to 61*n* by wires Pl to Pn arranged on the TAB films. Hence, drives signals can be supplied from the output terminals to the column electrodes 61*l* to 61*n*. The LSI chips 641 and 642 can store the display data supplied from an external source and can convert the data into signals for driving the pixels.

Let us assume that there are 24 column electrodes. In this case, the LSI chip 641 outputs 12 pixel data items for the first twelve of the 24 pixels forming one display line, to the first twelve of the 24 column electrodes which are located on the left-half part of the display screen. And, the LSI chip 642 outputs puts 12 pixel data items for the remaining twelve pixels forming the display line, to the remaining twelve column electrodes which are located on the right part of the display screen.

As is shown in FIG. 8, the liquid crystal display apparatus further comprises a liquid-crystal drive circuit 65. This circuit 65 is designed to supply timedivision drive signals having different phases to the row electrodes 62*l* to 62*m*, such that a different potential corresponding to the voltage of the drive signal supplied to each row electrode is applied to the pixels defined by this row electrode and the column electrodes 61*l* to 61*n*.

Since the wires Pl to Pn connected to the column electrodes 61*l* to 61*n* are arranged on the TAB film 631 and 632, both which are secured to the upper edge of the display panel 60, the pitch at which they are placed is inevitably short. Obviously, the more column electrodes, arranged horizontally to display higher-quality images, the shorter the pitch, the higher the manufacturing cost of the apparatus, and the lower the reliability thereof.

This problem is solved by the conventional system illustrated in FIG. 9. As is shown in FIG. 9, the system has a display panel 60 which is identical to that one shown in FIG. 8. TAB films 631 and 632, on which LSI chips 641 and 642 are mounted, are secured to the upper and lower edges a display panel 60, respectively. Signals are supplied from the LSI chip 641 to the odd-numbered column electrodes arranged on the panel 60, whereas signals are supplied from the LSI chip 642 to the even-numbered column electrodes. The wires connected to either LSI chip are, thus, arranged at a relatively long pitch.

The system shown in FIG. 9 has data switching circuit 66 and a CPU (not shown). The circuit 66 receives dot-matrix display data items from an external source. Under the control of the CPU, the circuit 66 distributes the data items, alternately to the LSI chip 641 and the LSI chip 642. This distribution of data items should be performed at high speed, and the CPU cannot control the switching circuit 66 appropriately unless it is a high-performance CPU.

SUMMARY OF THE INVENTION

The primary object of the invention is to provide a dot-matrix format liquid crystal display apparatus, which features simplified structure of the display panel and the display-panel drive circuit, irrespective of the increased number of pixels and the accelerated display control speed. In particular, the liquid crystal display apparatus embodied by the invention smoothly displays liquid crystal character or image patterns without causing the CPU to sustain unnecessary an burden in its data-display control capability.

Another object of the invention is to provide integrated circuits for driving a liquid-crystal display panel, which are respectively capable of distributing pixel data items to each column electrode of the display panel by characteristically minimizing the burden of the CPU in controlling data switching operation.

A still further object of the invention is to provide a dot-matrix liquid crystal display apparatus, which can fully satisfy the need for processing the increased pixels at an extremely fast speed.

The present invention relates to a dot-matrix display apparatus which includes a liquid-crystal display panel. The display panel has a number of column electrodes defining columns of pixels which extend in a first direction; a number of row electrodes defining rows of pixels which extend in a second direction intersecting with the first direction; and the first and second display drive integrated circuits which are installed on both sides of the liquid crystal display panel in the first direction, where the first and second display drive integrated circuits respectively distribute pixel data items to those column electrodes disposed in odd positions and those column electrodes in the even positions. The first and second display drive integrated circuits respectively receive display data in parallel with each other and then select the odd pixel data items and the even pixel data items from the received display data.

Therefore, according to the liquid crystal display apparatus featuring the above structure, the first and second display drive integrated circuits respectively select only specific pixel data items needed for either of them at a fast speed from the received display data composed of continuous pixel data items, and yet, there is no need of performing a switching operation in correspondence with the oddness and the evenness of pixel data items being transmitted at a fast speed. As a result, the dot-matrix liquid crystal display apparatus embodied by the invention can fully process displayable data at an accelerated speed. Furthermore, the liquid crystal display apparatus embodied by the invention can securely process the increased number of displayable pixels.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 1:
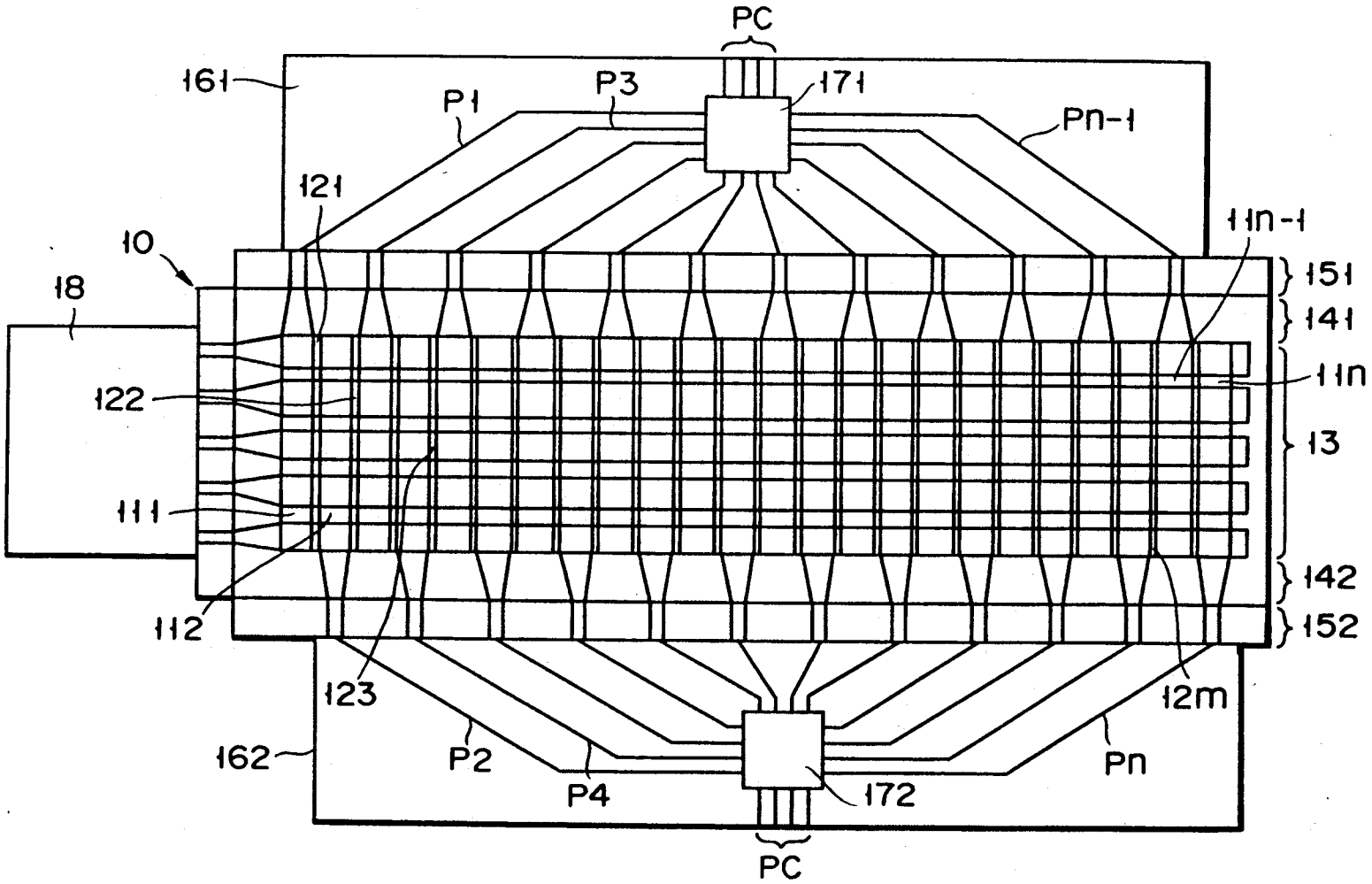
FIG. 1 illustrates the structure of the first embodiment of the dot-matrix liquid crystal display apparatus of the invention according to the front view.

The reference numeral 10 shown in FIG. 1 designates an embodiment of dot-matrix liquid crystal display panel of the present invention. Although not being shown in detail, the liquid crystal display panel 10 is composed of a pair of glass plates, which are opposite from each other across a narrow clearance and a panel-shape sealing container which envelops external edges of these transparent substrates. The sealing container is filled with liquid crystal. A certain number of strip-shaped column electrodes 11*l* to 11*n* are arranged parallel to a first (horizontal) direction on the inner surface of one of the grass plates. A certain number of strip-shaped row electrodes 12*l* to 12*m* are arranged parallel to a second (vertical) direction on the inner surface of another glass plate. A differential potential between the column and row electrodes can selectively be set to those portions where the column electrodes 11*l* to 11*n* and row electrodes 12*l* to 12*m* cross each other, so that displayable pixels can be produced at respective crossing positions by controlling crystal lines of liquid crystals in the crossing positions. A polaroid sheet is set in opposition from the display surface of the panel-shape sealing container.

More particularly, the center of the display panel 10, allowing the column electrodes 11*l* to 11*n* and the row electrodes 12*l* to 12*m* to cross each other, substantially comprises display portion 13. Wiring portions 141 and 142 are formed on the extended portions from the upper and bottom sides of the display portion 13. Electrode terminals 151 and 152 are formed extending to the upper and bottom sides of the display portion 13 beyond the wiring portions 141 and 142. Wires extended from the odd column electrodes 111, 113, . . . 11*n*−1, and even-column electrodes 112, 114, . . . 11*n*, are set to the wiring portions 141 and 142. Output terminals connected to these wires are provided for the electrode terminals 151 and 152.

The first and second TAB films 161 and 162 are secured to the edges (where the electrode terminals 151 and 152 are installed) of the display panel 10. The TAB films 161 and 162 respectively mount the first and second integrated circuits 171 and 172, which are respectively composed of semiconductor LSI chips for controlling the display drive operation.

The odd-numbered column electrodes 111, 113, . . . 11*n*−1 of the first display drive integrated circuit 171 are respectively provided with output terminals, which externally output pixel data items. The even-numbered column electrodes 112, 114, . . . 11*n* of the second display drive integrated circuit 172 are respectively provided with output terminals which externally output pixel data items.

The first and second TAB films 161 and 162 mounting the first and second display drive integrated circuits 171 and 172 are respectively provided with wires Pl, P3, . . . P*n*−1, P2, P4, . . . Pn by printing means. Pixel signals output from the first and second display drive integrated circuits 171 and 172 are distributed to the odd-numbered column electrodes 111, 113, . . . 11*n*−1 and the even-numbered column electrodes 112, 114, 11*n*, of the display panel 10 through the electrode terminals 151 and 152 and the wired portions 142 and 144.

The first and second display drive integrated circuits 171 and 172 respectively receive dot-matrix display data PC from an external source in parallel with each other. The dot-matrix display data PC is composed of digital pixel data items corresponding to each pixel aligned in the horizontal direction. These digital pixel data items are aligned in order of pixels, and yet, each pixel corresponds to the column electrodes 11*l* to 11*n*.

The first and second display drive integrated circuits 171 and 172 are respectively composed of odd/even-numbered selection means, which selects pixel data items corresponding to the odd-numbered pixels and the even-numbered pixels from the input display data PC, and pixel drive signal output means which converts the pixels selected by the selection means into pixel drive signals to be delivered to each column electrode and then outputs these signals.

The first display drive integrated circuit 171 selects pixel data items corresponding to the odd-numbered pixels from the display data received from external source, and then converts the selected pixel data items into pixel drive signals before delivering these signals to the odd-numbered column electrodes 111, 113, . . . 11*n*−1 in series. The second display drive integrated circuit 172 selects pixel data items corresponding to the even-numbered pixels from the display data received from the external source, and then converts the selected pixel data items into pixel drive signals before delivering these signals to the even-numbered column electrodes 112, 114, . . . 11*n*, in parallel with each other.

More particularly, the liquid crystal display apparatus embodied by the invention feeds identical input display data to the first and second display drive integrated circuits 171 and 172. The first and second display drive integrated circuits 171 and 172 select only the respective odd-numbered or even-numbered pixel data items from the input display data at an extremely fast speed. In other words, the display drive integrated circuits 171 and 172 respectively discard unnecessary pixel data items. As a result of the introduction of the display drive integrated circuits executing the above signal processing operation, the liquid crystal display apparatus embodied by the invention dispenses with the conventional data-switching circuit 66 (shown in FIG. 9) which obliges the CPU to control alternate switching of pixel data items. By eliminating these unnecessary processes, the liquid crystal display apparatus embodied by the invention can securely accelerate the display.

The first and second display drive integrated circuits 171 and 172 are respectively mounted on the TAB films 161 and 162. Wires P1, P3, . . . P*n*−1, and P2, P4, . . . Pn installed to the TAB films 161 and 162 are respectively connected to terminal wires of the terminals 151 and 152 of the display panel 10. When assembling these elements, since these wires are solely connected to the odd-numbered and even-numbered elements, wiring pitch can securely be extended. This in turn facilitates the assembly operation and promotes reliability. Furthermore, wiring process for the wiring portions 141 and 142 of the display panel 10 can easily and linearly be executed within the shortest distance. This diminishes the area of the wiring portions 141 and 142 of the display panel 10, and as a result, the total area of the display portion 13 can easily be expanded.

Those row electrodes 12*l* to 12*m* provided for the display panel 10 are respectively connected to liquid-crystal drive circuit 18, which sequentially distributes drive signals having different phases to each of the row electrodes 12*l* to 12*m*.

A variety of structures can be taken into consideration for the first and second display drive integrated circuits 171 and 172 distributing pixel data signals to a number of column electrodes 11*l* to 11*n*. For example, each of these display drive integrated circuits may be provided with RAM storing display data or a shift register accumulating display data.

Figure 2:
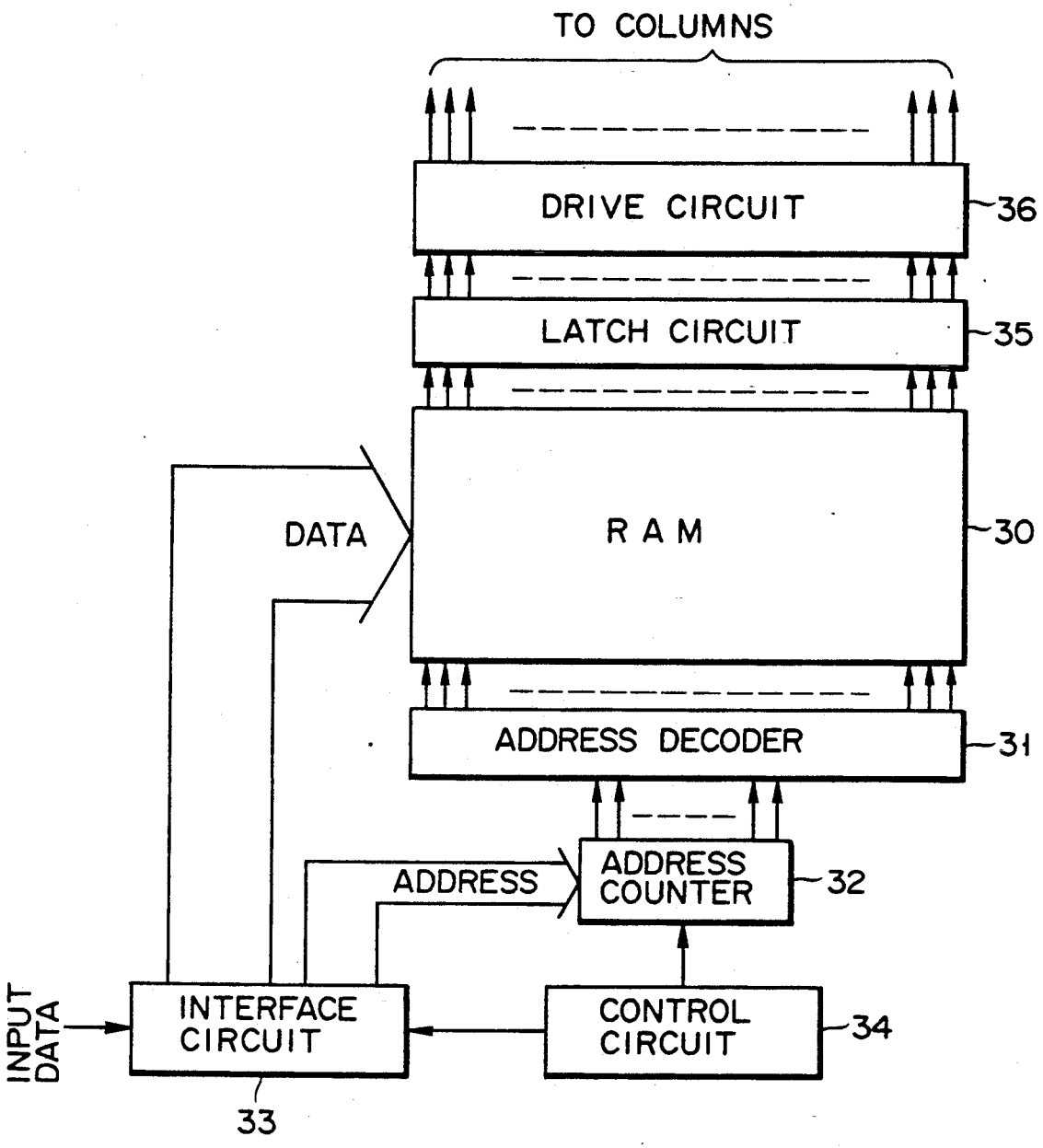
FIG. 2 illustrates the first embodiment of the display drive integrated circuits of the liquid crystal apparatus of the invention.

FIG. 2 illustrates a block diagram of the first display drive integrated circuit 171. The second display drive integrated circuit 172 is also provided with the identical structure. The first display drive integrated circuit 171 includes RAM 30, which writes pixel data items for composing display data. Address decoder 31 specifies the writing address for the RAM 30. Address counter 32 delivers address signal to the address decoder 31 and receives address data from interface circuit 33. PCU (which is not shown, but is provided outside the first display drive integrated circuit) delivers the writing data and the address data to the interface circuit 33. The writing data is composed of continuous pixel data items which compose display data of the dot-matrix display apparatus. These pixel data items (composing write display data), delivered to the interface circuit 33, are then transmitted to the RAM 30 as the writing data.

The interface circuit 33 and the address counter 32 are controlled by a control circuit 34. The control circuit 34 selects those pixel data items corresponding to the odd-numbered pixels from the continuous pixel data items composing display data to be delivered to the interface circuit 33, and then the control circuit 34 delivers the selected pixel data items to the RAM 30 as the writing data. With the delivery of pixel data items to the RAM 30, the control circuit 34 also delivers address signals to the address counter 32. Odd or even data selection means is composed of this data-writing control means.

The even pixel data items are output from the interface circuit 33 of the second display drive integrated circuit 172, so that this data can be written into the RAM 30. Either the odd-numbered or the even-numbered pixel data items selected by this data-selection means is written into the RAM 30. The group of those pixel data items are read out of the RAM 30 as one-pixel line unit in the horizontal direction of the display panel 10 before being stored in latch circuit 35. Next, pixel data items corresponding to either the odd-numbered or the even-numbered pixels of the one-pixel line stored in the latch circuit 35 is then delivered to display drive circuit 36, which then distributes these data to those column electrodes corresponding to respective pixel data items.

Figure 3:
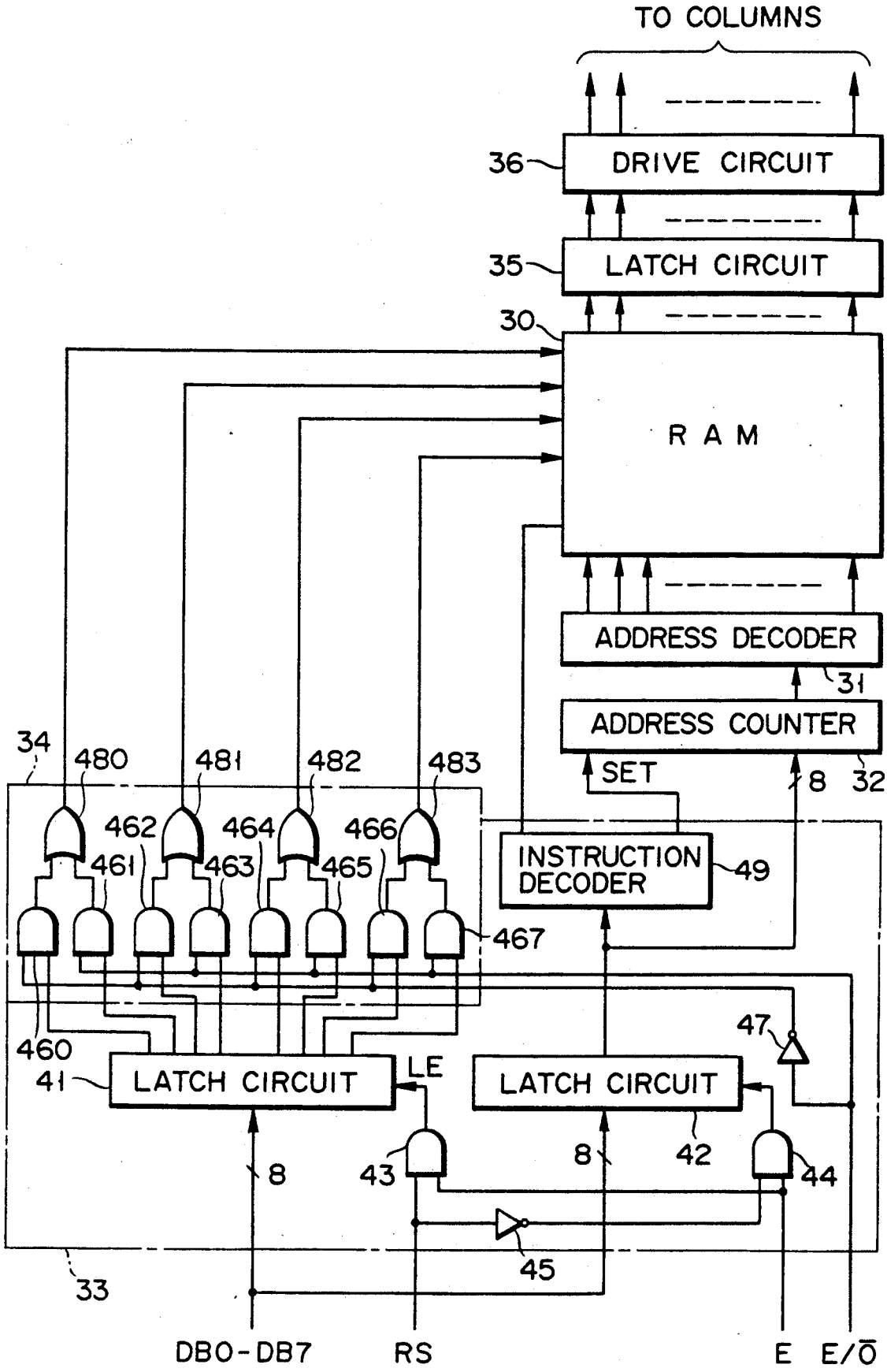
FIG. 3 illustrates the second embodiment of the display drive integrated circuits related to the invention.

FIG. 3 illustrates the second example of the controller which writes data into the RAM 30. For explanatory purpose, it is assumed that there are 8 pixels in the horizontal direction. The controller feeds data corresponding to 4 pixels to the RAM 30 for writing.

Eight-bit display data DB0 to DB7 are delivered to the controller in correspondence with 8 pixels. The input display data is delivered to latch circuit 41. Simultaneously, this data, functioning as instruction data is also delivered to latch circuit 42. The AND circuit 43 receives register select RS signal, functioning as gate signal. The AND circuit 43 delivers enable signal E, functioning as latch instruction signal, to the latch circuit 41. Another AND circuit 44, in receipt of the enable signal, delivers the latch instruction signal to the latch circuit 42. The AND circuit 44 receives the register select signal RS (functioning as the gate signal) via inverter 45. The latch circuit 41 latches the enable 8-bit display data in correspondence with the register select signal RS. The latch circuit 42 latches the 8-bit instruction signal when the register select signal is at a low level.

The enable 8-bit display data latched by the latch circuit 41 are respectively delivered to AND circuits 460 to 467. Those AND circuits 460, 462, 464, and 466, disposed in the odd positions respectively feed gate signals after causing inverter 47 to invert Even/Odd ($E/\overline{O}$) signal for selecting either the odd-numbered or the even-numbered positions. Those AND circuits 461, 463, 465, and 467, disposed in the even-numbered positions respectively feed the E/$\overline{O}$ signal as the gate signal. In consequence, when the E/$\overline{O}$ signal is at a low level (L), those AND circuits disposed in the odd-numbered positions respectively output odd-bit signals. On the other hand, when the E/$\overline{O}$ signal is at a high level (H), those AND circuits disposed in the even-numbered positions respectively output even-bit signals. Either the odd-bit signals or the even-bit signals are delivered to the RAM 30 via OR circuits 480 to 483 as the writing signal.

Those gate circuits mentioned above respectively execute specific function corresponding to that of the control circuit 34 shown in FIG. 2.

The data latched by the latch circuit 42 is delivered to instruction decoder 49 and address counter 32 which then delivers address data to the address counter 32 which is set by SET signal from the latch circuit 42. The instruction decoder 49 outputs a write instruction to the RAM 30. In other words, the latch circuits 41 and 42 and the instruction decoder 49 respectively perform specific functions corresponding to these of the interface circuit 33 shown in FIG. 2.

Referring to the first and second display drive integrated circuits 171 and 172 incorporating the data-writing controller, featuring the structure mentioned above, the first integrated circuit 171 selecting display data corresponding to the odd-numbered pixels, and the second integrated circuit 172 selecting display data corresponding to the even-numbered pixels can be provided with a structure identical to each other. The first integrated circuit 171 sets the E/$\overline{O}$ signal so that it can remain at a low level, when selecting the odd-numbered display data. The second integrated circuit 172 sets the E/$\overline{O}$ signal so that it can remain at a high level, when selecting the even-numbered display data.

Figure 4:
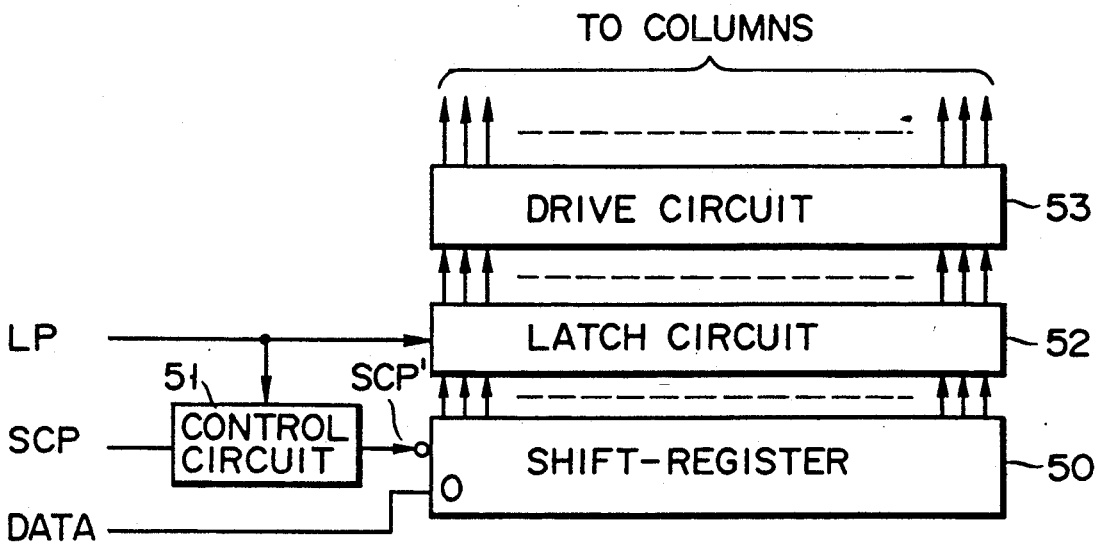
FIG. 4 illustrates the third embodiment of the display drive integrated circuits related to the invention.

FIG. 4 illustrates another embodiment of the first and second integrated circuits 171 and 172, in which shift register 50 is additionally provided. The shift register 50 receives display data composed of continuous pixel data items. Based on shift clock signal SCP′ delivered from control circuit 51, data is written into the shift register 50, and then shift control is executed. Using latch pulse LP, latch circuit 52 latches the pixel data items written in the shift register 50, and then the latched pixel data items are delivered to display drive circuit 53. Display drive signal output from the display drive circuit 53 is distributed to the odd-numbered or the even-numbered column electrodes. Synchronous with the fall of the latch pulse LP, the latch circuit 52 reads the pixel data items from the shift register 50 before latching them.

Figure 5:
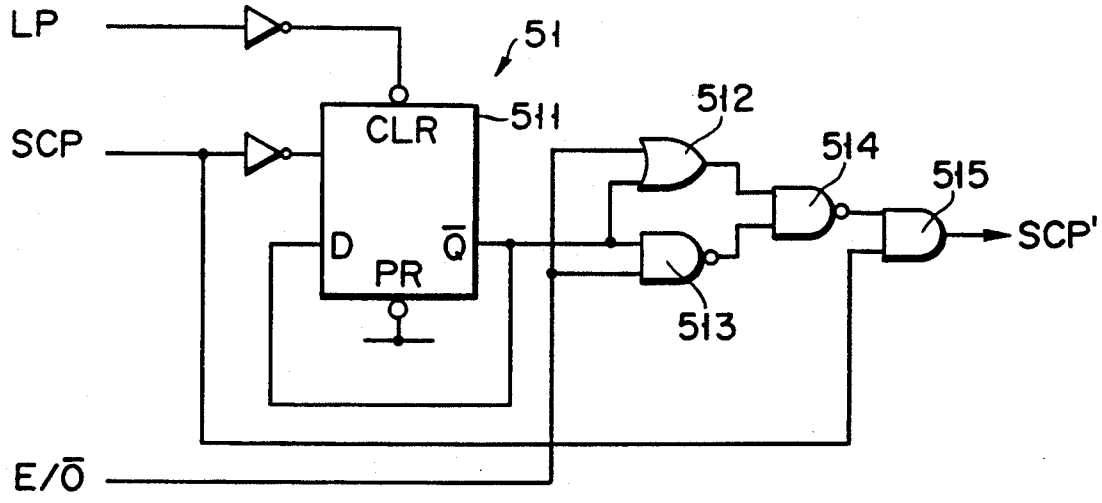
FIG. 5 illustrates the detailed block diagram of the control circuit composing the display drive integrated circuits shown in FIG. 4.

FIG. 5 illustrates the structure of the control circuit 51 incorporating flip flop 511. The flip flop 511 receives shift-clock pulse SCP and latch pulse LP which functions synchronously.

When output $\overline{Q}$ of flip flop 51 and signal E/$\overline{O}$ are at a high-level, the output of OR circuit 512 and the output of NAND circuit 513 are at a high-level and a low-level, respectively. Under this condition the output of NAND circuit 514 is at a high-level so that the output of AND circuit 515 as a gate signal, SPC′, is output at a high-level when $\overline{Q}$ and clock SCP′ are at a high-level, as shown in FIG. 6.

Figure 6:
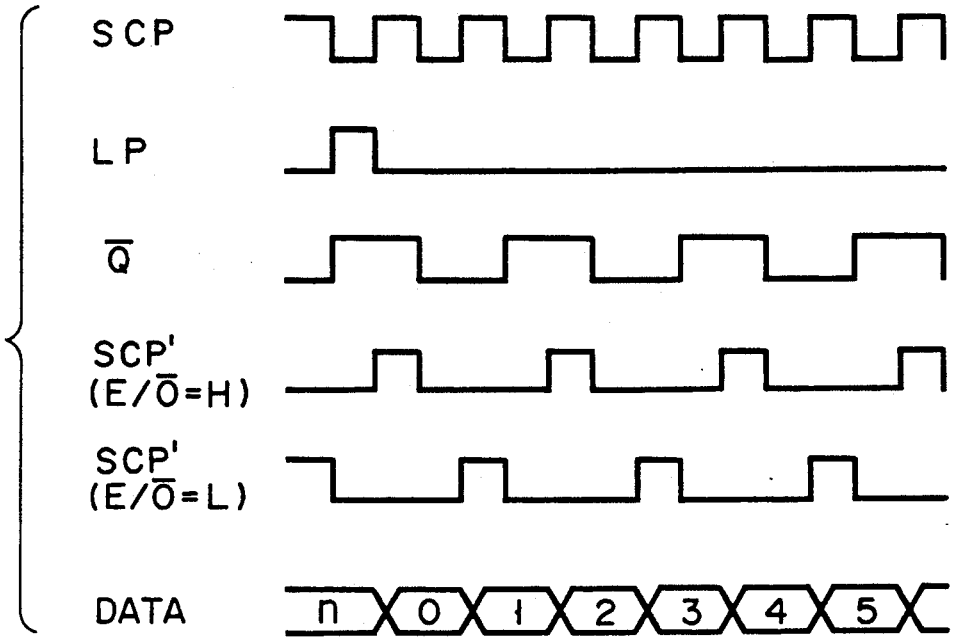
FIG. 6 illustrates a timing-chart of the functional operation of the display drive integrated circuits.
Figure 7:
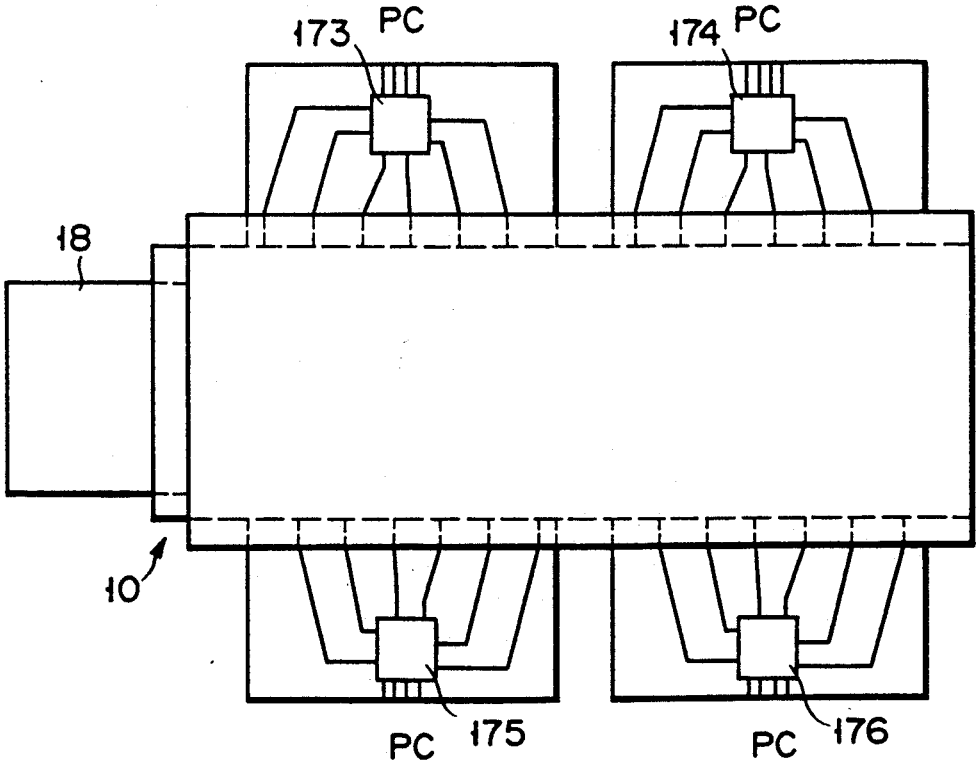
FIG. 7 illustrates the structure of the second embodiment of the dot-matrix liquid crystal display apparatus of the invention according to the front view.
Figure 8:
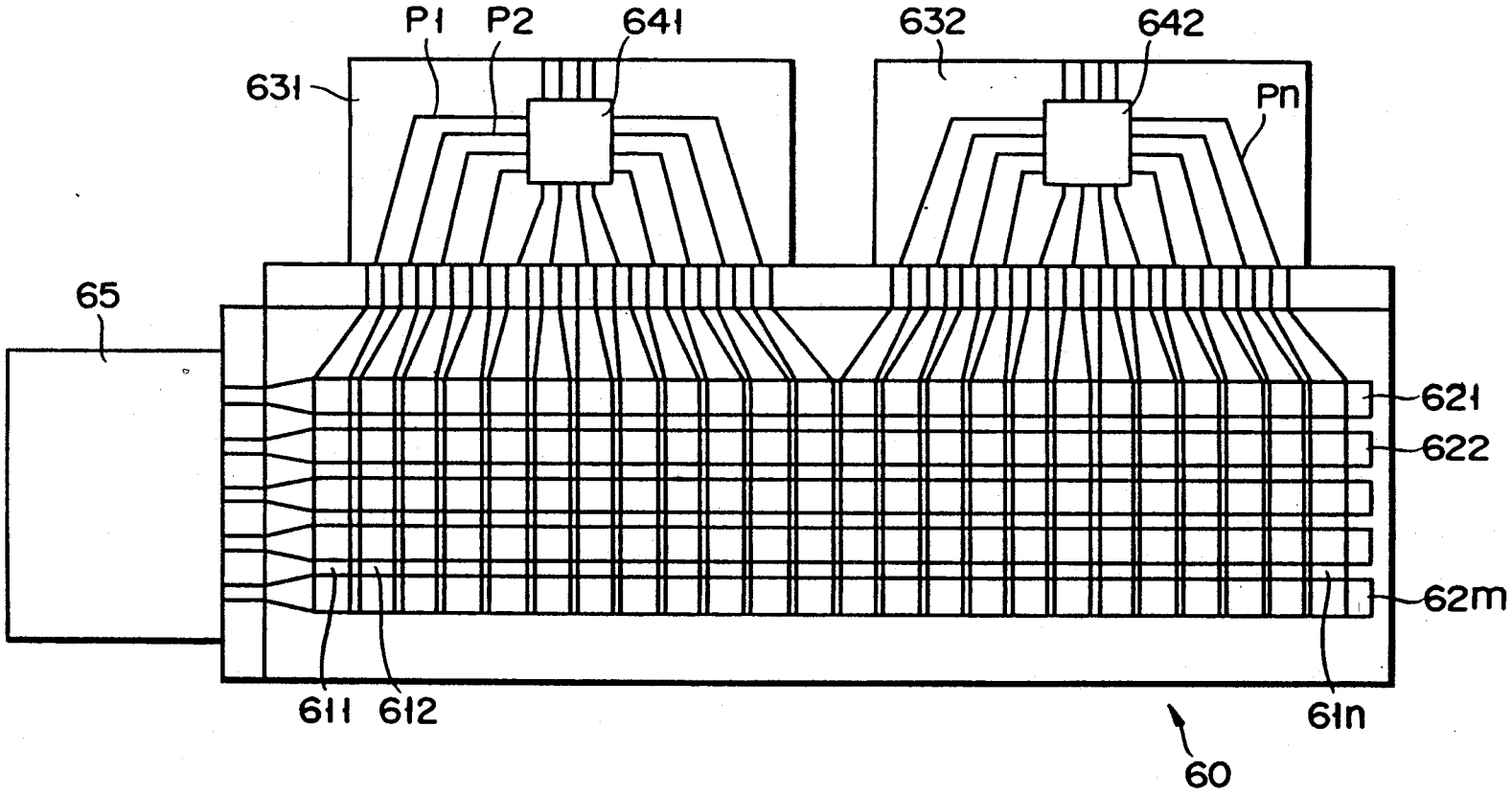
FIG. 8 (PRIOR ART)
FIGS. 8 and 9 respectively illustrate the first and second examples of conventional liquid crystal apparatus.

When signal E/$\overline{O}$ is at a low-level, the output of NAND circuit 513 is at a high-level, and the output from OR circuit 512 corresponds to the level of the output from $\overline{Q}$ of flip-flop 51, so that a high-level signal is output from NAND circuit 514 when $\overline{Q}$ is at a low-level, permitting signal SCP′ corresponding to clock SPC, to be output at a high level when $\overline{Q}$ is at a low-level, as shown in FIG. 6.

While the above processes are underway, in correspondence with the level of the E/$\overline{O}$ signal delivered to the gate circuit group 512–515 and synchronous with either the odd-numbered pixel data items or the even-numbered pixel data items, output pulse SCP's is generated.

The liquid crystal display apparatus shown in the above embodiment allows the drive circuit 18 to deliver a time-division drive signal to the row electrodes 121 to **12*m*, and also allows specific circuits other than the first and second integrated circuits 171 and 172 to control the row electrodes 12*l* to 12*m*. Nevertheless, the invention also allows the first integrated circuit 171 and/or the second integrated circuit 172 to incorporate a specific function to generate time-division signals for controlling the row electrodes 12*l* to 12*m***.

The foregoing embodiment sets a pair of display drive integrated circuits to the opposite sides of the display panel 10, and divides a number of column electrodes into odd-numbered and even-numbered positions so that either of these odd-numbered and even-numbered column electrodes can be driven by one of the opposite integrated circuits.

Figure 9:
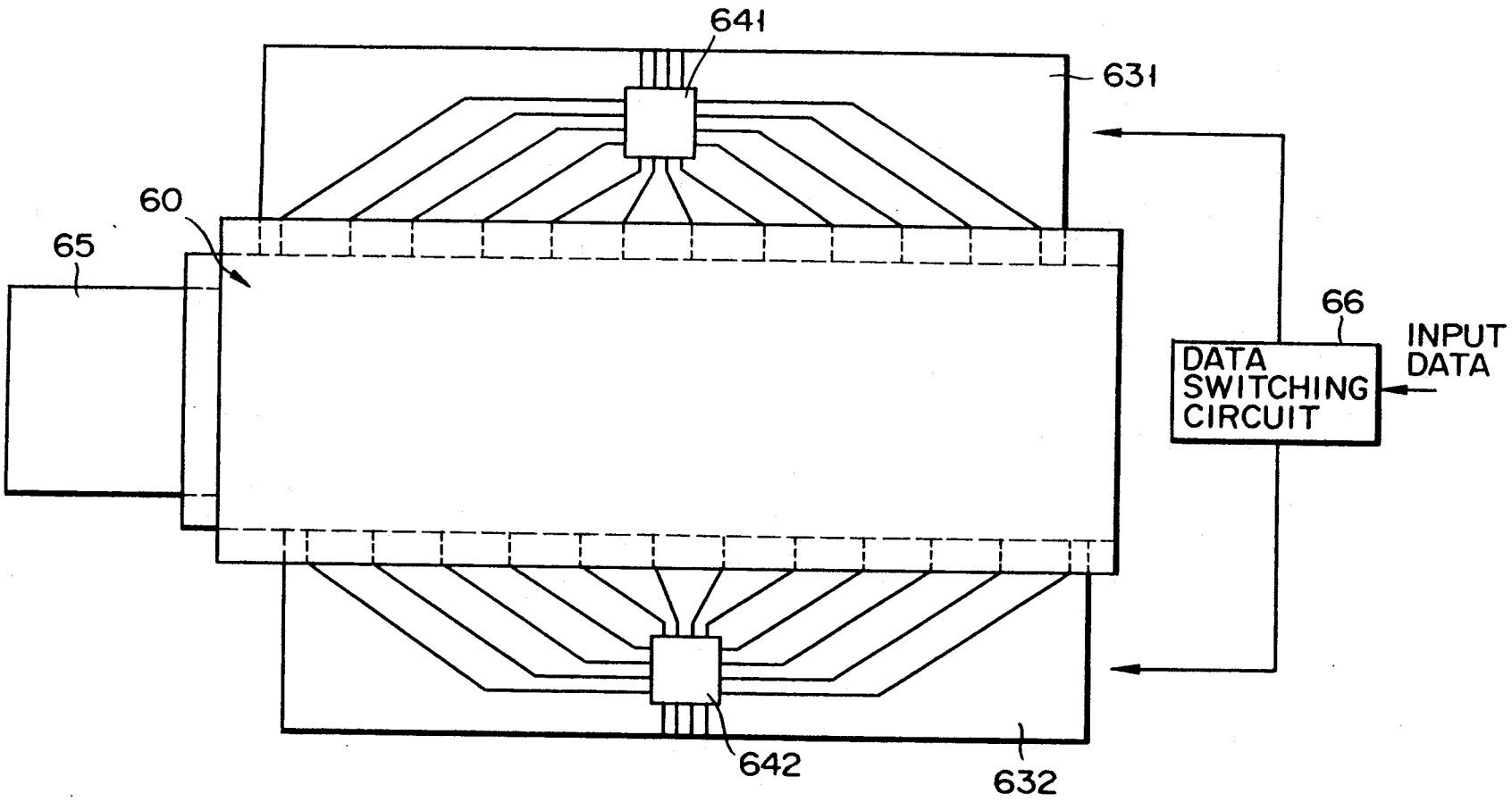
FIG. 9 (PRIOR ART)

Nevertheless, if manufacturing tries to expand the display screen and thicken the density of pixels of the dot-matrix liquid crystal display, the number of the column and row electrodes unavoidably increases. To solve this problem, it is suggested that the number of the integrated circuits set to one-side of the display panel 10 be increased. For example, as shown in FIG. 9, a pair of integrated circuits 173 and 174 are installed in order to deliver display drive signals to the odd-numbered column electrodes. At the same time, the odd-numbered column electrodes are separately disposed to the left and to the right of the drawing so that the integrated circuits 173 and 174 can respectively take care of the divided range. When implementing this, another pair of integrated circuits 175 and 176 respectively generate display drive signals for delivery to the even-numbered column electrodes.

The above embodiment has merely shown a liquid crystal display panel typical of a dot-matrix display panel. Nevertheless, the display panel is not merely confined to the one which allows liquid crystal to display pixels, but the invention is also effectively applicable to such a dot-matrix display apparatus which displays pixels by means of discharge, for example.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A dot-matrix display apparatus comprising:

a display panel having a plurality of column electrodes defining columns of pixels extending in a first direction, and a plurality of row electrodes defining rows of pixels extending in a second direction, intersecting with the first direction;

a first integrated circuit for receiving serial display data consisting of odd-numbered and even-numbered pixel data items corresponding to the pixels arranged in the first direction and a high-level selection signal, for extracting odd-numbered one of the pixel data items, and for supplying the extracted odd-numbered pixel data items to odd-numbered ones of said column electrodes, said first integrated circuit including:

selection means for selecting the odd-numbered pixel data items from the display data in accordance with the high-level selection signal; and pixel-driving signal distributing means for sequentially distributing the odd-numbered pixel data items selected by the selection means to said odd-numbered column electrodes as pixel-driving signals; and a second integrated circuit for receiving serial display data consisting of odd-numbered and even-numbered pixel data items corresponding to the pixels arranged in the first direction and a low-level selection signal, for extracting even-numbered ones of the pixel data items, and for supplying the even-numbered pixel data items to even-numbered ones of said column electrodes, said second integrated circuit including:

selection means for selecting the even-numbered pixel data items from the display data in accordance with the low-level selection signal; and pixel-driving signal distributing means for sequentially distributing the even-numbered pixel data items selected by the selection means to said even-numbered column electrodes as pixel-driving signals.

2. The apparatus according to claim 1, wherein said first and second integrated circuits are mounted on a first insulative film and a second insulative film, respectively, said first and second insulative films being secured to side edges of said display panel which are positioned apart in the first direction, a first set of wires being arranged on said first insulative film and connecting said first integrated circuit to said odd-numbered column electrodes, and a second set of wires being arranged on said second insulative film and connecting said second integrated circuit to said even-numbered column electrodes.

3. The apparatus according to claim 1, wherein said selection means comprises interface circuit means for selecting one of the odd-numbered pixel data items and the even-numbered pixel data items, and memory means for sequentially storing the pixel data items output from the interface circuit means, at address locations respectively corresponding to positions of said odd-numbered column electrodes and said even-numbered column electrodes.

4. The apparatus according to claim 3, wherein said interface circuit includes an address signal generator for generating address signals corresponding to either the odd-numbered pixel data items or the even-numbered pixel data items, and an address counter for supplying address data to said memory means in accordance with the address signals generated by the address signal generator.

5. The apparatus according to claim 3, further comprising data-latching means for simultaneously latching the pixel data items corresponding to either said odd-numbered column electrodes or said even-numbered column electrodes, and for simultaneously supplying the pixel data items to said odd-numbered column electrodes or said even-numbered column electrodes.

6. The apparatus according to claim 1, which further comprises memory means, and in which said first integrated circuit further comprises a latch circuit for latching display data consisting of bits corresponding to said pixels, a plurality of two-input AND circuits, with first and second inputs, for receiving the bits at the first inputs, and for receiving gate signals the second inputs of odd-numbered ones of said two-input AND circuits, whereby the odd-numbered AND circuits output bits which are written as display data into said memory means.

7. The apparatus according to claim 1, which further comprises memory means, and in which said first integrated circuit further comprises a latch circuit for latching display data consisting of bits corresponding to said pixels, a plurality of two-input AND circuits, with first and second inputs, for receiving the bits at the first inputs, and for receiving gate signals the second inputs of even-numbered ones of said two-input AND circuits, whereby the even-numbered AND circuits output bits which are written as display data into said memory means.

8. The apparatus according to claim 1, wherein said first and second integrated circuits further comprise a shift register means for sequentially receiving pixel data items corresponding to said column electrodes, and control means for selecting respective odd-numbered or even-numbered ones of shift clock pulses corresponding to said pixel data items and for supplying the selected shift clock pulses to said shift register, whereby the pixel data items stored at odd-numbered or even-numbered digits of said shift register are respectively simultaneously read out and distributed to the odd-numbered column electrodes and the even-numbered column electrodes.

9. The apparatus according to claim 8, wherein said control means includes frequency-dividing means for frequency-dividing shift clock pulses synchronous with said pixel data items, thereby generating pulses, and a plurality of gate circuits for receiving the pulses generated by said frequency-dividing means, for outputting shift clock pulses corresponding to the odd-numbered pixels and for outputting shift clock pulses corresponding to the even-numbered pixels, in accordance with an odd/even selecting signal.

* * * * *

UNITED STATES PATENT AND TRADEMARK OFFICE

CERTIFICATE OF CORRECTION

PATENT NO. : 5,241,304

DATED : August 31, 1993

INVENTOR(S) : Eiichi Munetsugu et al.

It is certified that error appears in the above-indentified patent and that said Letters Patent is hereby corrected as shown below:

Claim 1, column 9, line 1, change "one" to --ones--.

Signed and Sealed this

Sixteenth Day of August, 1994

Bruce Lehman

*Attest:*

BRUCE LEHMAN

*Attesting Officer*

*Commissioner of Patents and Trademarks*